US006776247B1

(12) United States Patent
Bassal

(10) Patent No.: US 6,776,247 B1
(45) Date of Patent: Aug. 17, 2004

(54) STABILIZER TOOL BLOCK WEAR PAD ASSEMBLY

(75) Inventor: Adel Ali Bassal, Parafield Gardens (AU)

(73) Assignee: Gearhart Australia Ltd., Bentley (AU)

( * ) Notice: Subject to any disclaimer, the term of this patent is extended or adjusted under 35 U.S.C. 154(b) by 0 days.

(21) Appl. No.: 09/937,403

(22) PCT Filed: Mar. 23, 2000

(86) PCT No.: PCT/AU00/00230

§ 371 (c)(1),
(2), (4) Date: Jan. 23, 2002

(87) PCT Pub. No.: WO00/58596

PCT Pub. Date: Oct. 5, 2000

(30) Foreign Application Priority Data

Mar. 26, 1999 (AU) ..... PP9462

(51) Int. Cl.[7] ..... E21B 17/10

(52) U.S. Cl. ..... 175/325.4; 175/325.2; 166/241.2

(58) Field of Search ..... 166/241.1, 241.2, 166/241.6; 175/325.1, 325.5, 324.5

(56) References Cited

U.S. PATENT DOCUMENTS

| | | | | |
|---|---|---|---|---|
| 3,818,999 A | | 6/1974 | Garrett | |
| 4,323,131 A | | 4/1982 | Allee | |
| 4,557,339 A | | 12/1985 | Falknor et al. | |
| 4,662,461 A | * | 5/1987 | Garrett | 175/325.4 |
| 5,337,843 A | * | 8/1994 | Torgrimsen et al. | 175/334 |
| 5,868,212 A | * | 2/1999 | McManus | 175/325.4 |
| 6,427,791 B1 | * | 8/2002 | Glowka et al. | 175/413 |

FOREIGN PATENT DOCUMENTS

| | | | | |
|---|---|---|---|---|
| AU | 39880/97 | | 4/1998 | |
| GB | 2030616 A | * | 4/1980 | E21B/17/10 |
| WO | WO/97 06342 A | | 2/1997 | |
| WO | WO 97/06342 | | 2/1997 | |
| WO | WO/97 45620 A | | 12/1997 | |

* cited by examiner

*Primary Examiner*—David Bagnell
*Assistant Examiner*—Jennifer H Gay
(74) *Attorney, Agent, or Firm*—Nixon Peabody LLP; Donald R. Studebaker

(57) ABSTRACT

The present invention is for a drill string stabiliser tool (18) used in borehole drilling. The tool includes a symmetrical body (20) with a plurality of external recesses (22). The recesses (22) have internal opposite surfaces (23) which converge inwardly from the outer surface of the body. A pad assembly (24) is disposed in each recess (22) and includes a wedge block (28) with converging radially inwardly opposite side surface (29) complementarily abutting said recess surfaces. Each wedge block (28) has a bolt (30) securing said wedge block (28) to said body (20) and is slightly larger dimensioned than the recess (22). The angles of the wedge blocks and the recesses are so chosen to effect an interference fit so that when the wedge block (28) is forced into the recess (22) by use of the bolt (30) it is held there by an interference fit.

15 Claims, 5 Drawing Sheets

STABILIZER TOOL BLOCK WEAR PAD ASSEMBLY

The present invention relates to stabiliser tool and a wedge assembly for use in stabiliser tools that stabilise the operation of a drill string in a borehole drilling through the earth's surface.

BACKGROUND OF THE INVENTION

In operation boreholes are initially drilled as vertical holes and may then curve to an inclined or horizontal direction. Maintaining of complete control is very important but very difficult to achieve. A borehole drill may, for example, include three cutters or reamers, which are circumferentially spaced from one another. When the drill bit is inclined to the original axis, the space between the cutters can cause erratic or irregular operation in negotiating a curve.

So as to maintain control of the drill string, it is known to use a stabiliser tool having projecting wear pad assemblies. Generally a stabiliser tool includes recesses containing projecting pad assemblies arranged in a spaced configuration, with each pad assembly generally having two outer blocks and a central wedge block. The recesses have at least two side walls that diverge radially inwardly by an included angle providing an undercut recess surface. The outer blocks include diverging outer side walls of the same angle as the recess side walls. The outer walls are retained in abutment with the undercut recess surface by the wedge block acting on the inner walls of the outer blocks, the central wedge block having inwardly converging walls of the same angle as the diverging inner walls of the outer blocks. An appropriate bolt draws the central wedge into the gap between the outer blocks and causes them to move outwardly into firm abutment with the undercut recess thus locking them in place. The advantage of this configuration is that to repair or replace the wear pad assemblies one only needs to remove the central wedge block between the two outer blocks that then can be moved towards each other and away from the recess walls that locked them in place.

The difficulty with that configuration is that if the bolt locking the central wedge assembly in the recess were to break the central wedge may come away from the recess. This then allows the outer blocks to move away from the recess side walls and away from the recess. The end result is that the drill string may be jammed in a borehole, whereupon abandonment is unavoidable. In addition, not only is a multi-block wear pad assembly relatively expensive to manufacture, the manufacture of a recess with inwardly diverging side walls is also a complex task. Since the cost of the drill string is quite high it is an object of the present invention to provide improvements in stabiliser tools which overcome at least some of the abovementioned problems or provide a useful alternative.

BRIEF SUMMARY OF THE INVENTION

In one aspect of the invention a drill string stabiliser tool has a body having an outer surface symmetrical about an axis of rotation, and a plurality of recesses extending inwardly from said outer surface;

said recesses each including opposite surfaces which converge inwardly from said body outer surface;

a plurality of pad assemblies in respective said recesses, each said pad assembly including a wedge block with converging radially inwardly opposite side surfaces complementary abutted by said recess surfaces;

each said wedge block having a relatively hard outer wear surface located radially outwardly from said body surface, and a bolt securing said wedge block to said body;

characterised by the outer side surfaces of the wedge block converging inwardly at a pre-determined angle and the opposite surfaces of said recesses converging inwardly at the same pre-determined angle whereby said angle is so chosen to provide an interference fit between the outer side surfaces of said wedge block and opposite surfaces of said recesses.

It has been surprisingly found that, even under immense forces that may be imposed on the wedge (wear) blocks and that are transmitted to the inwardly converging recess surfaces, the interference fit locks the wedge blocks in their recesses and resists the tendency of them to be removed by compressive forces, turning moments, or both even if the central bolt locking the wedge were to break. This then allows the drill string to be removed from the borehole and the pad assembly to be repaired without having to be abandoned.

This is an unexpected result for intuitively it is thought that a recess whose sides are inwardly converging would need a locking mechanism, such as a bolt to hold the wedge block in the recesses. It has previously been assumed that an engaging member such as a bolt passing through the assembly locks the pad assemblies in place. Accordingly there have been a number of proposals for secondary locking mechanisms to prevent the loss of a drill string. It has however been the unexpected discovery by the present inventor, that such an interference fit provides the necessary locking force to keep the assembly locked in place and that the central bolt is essentially only required to urge the wedge block inwardly and outwardly to achieve or break the interference fit.

To assist in achieving an interference fit, the total size (or width) of the wedge block is preferably slightly larger (wider) than that of the recess. This ensures that an interference fit is properly achieved when the wedge block is urged into the recess. Generally one would calculate the width of the recess and the wedge block would then be manufactured to be of slightly larger dimension than the dimensions of the recess. In preference it has been found that if the wedge block is 3/1000 of an inch greater in width than the remaining width of the recess an effective interference fit occurs.

Thus to assemble the pad assembly a bolt is used to draw the central wedge into the recess resulting in an interference fit locking the assembly in place. To remove the pad assembly it is also necessary for the bolt to urge the wedge block outwardly and thus break the interference fit. Accordingly in use even if the central bolt were to break the interference fit has been found to lock the assembly in place.

In preference the predetermined angle depends on the material from which the assembly is manufactured. If made from steel, an angle of some 2 degrees has been found to produce an interference fit. However a range of angles of between 1.5 to 3.5 degrees has also been found to achieve an interference fit if the angle is greater or smaller than that range it has been found that an interference fit is not achieved and the wedge block is then only held in place by the bolt. If this were to break in a borehole than this could lead to the pad assembly becoming loose and being jammed in the borehole. Preferably the angle is some 2 degrees.

Further in the invention, there may be provided hard tipped cutters (for example polycrystallised diamond cutters) projecting outwardly from the sides of the wedge block, and if these are located towards the top end of the stabiliser and above the reamers of a drill string, the wall of a small bore hole will be enlarged upon withdrawal, thereby reducing likelihood of the drill string being jammed and lost in the hole. A negative rake of the cutters will still provide a cutting action, but may be effective in firmly compacting loose earth or rock upon withdrawal and avoid exacerbating the resistance to withdrawal by unnecessarily adding loose material between the cutters and reamers.

Preferably the wear blocks are positioned in a helical or spiral pattern that ensures that the drill stem upwardly of the reamers remains centralised, and during drilling, being above reamers (when used) the blocks will engage borehole surfaces which are more regular both in size and in smoothness than would exist if the reamers were not present. The stiffness below the stabiliser body of a reamer body and the bit assembly does much to avoid the difficulties previously encountered due to the spacing between the bits and the bit assembly, and thereby much improves the ability of an operator to control the direction of the bit movement.

In preference said wedge blocks are generally rectilinear in elevation, and side edges thereof are parallel in a plane normal to an axis of said bolt.

In preference each of some at least of said wedge blocks further include projecting hard tipped cutters.

In a further aspect of the invention there is proposed a drill string stabiliser tool including;

a) a body having an outer surface symmetrical about an axis of rotation, and a plurality of recesses extending inwardly from said outer surface and spaced in a helical configuration, said recess surfaces including opposite surfaces which converge inwardly from said body outer surface, each said recess being symmetrical about a central radial plane of said body;

b) a plurality of pad assemblies in respective said recesses, each said pad assembly having a wedge block having at least one pair of opposite sides converging towards said axis of rotation;

c) each said wedge block having a relatively hard outer wear surface located radially outwardly from said body surface, and a bolt securing said wedge block to said body;

e) each said wedge block containing surfaces defining a bolt hole extending from its said outer wear surface to a radially inner surface, slot surfaces extending transversely from a side of said wedge block defining a lateral slot extending across said bolt hole;

f) a U-shaped washer contained in said slot, and said bolt having a head bearing against said washer, accommodated in said slot, and accessible through said bolt hole from a said outer wear surface of said wedge block; wherein the at least one pair of opposite sides of the wedge block converging inwardly at a pre-determined angle and the opposite surfaces of said recesses converging inwardly at the same pre-determined angle whereby said angle is so chosen to provide an interference fit between the outer side surfaces of said wedge block and opposite surfaces of said recesses.

In preference at least some of said wedge blocks include projecting hard tipped cutters, said hard tipped cutters being arranged in an array with the extent of projection of the cutters from a said block increasing from the trailing end of said block to the leading end thereof, with respect to a boring direction of drill string rotation.

In preference it is only the uppermost of said wedge blocks that have said projecting hard tipped cutters.

In a yet further form of the invention there is proposed a drill string stabiliser including;

a) an elongate body adapted for rotation about a body axis;

b) the body including an outer surface including a plurality of spaced perimetral recesses arranged in a helical array;

c) a plurality of wear pads each positioned in an associated one of the recesses;

d) each pad having spaced side surfaces each complemental with an associated side surface of the associated recess;

e) the side surfaces of each associated pad and recess converging oppositely from the body surface to a base of the recess at an obtuse angle whereby to provide retention of each such pad in its associated recess by an interference fit;

f) each pad including a wear surface for drill string guiding engagement with a wall of a bore hole; and g) the complemental surfaces being position transversely of imaginary planes bisecting the body whereby forces applied to the mechanisms due to frictional engagement of the wear surfaces with a bore hole wall are applied transversely of the complemental surfaces.

In a still further from of the invention there is proposed a wear pad assembly for use with drill string stabiliser tools of the type having a plurality of recesses having inwardly converging side walls, said wear pad assembly including;

a wedge block having at least one pair of opposite side surfaces each side surface so shaped to complementary abut said recess surface;

each said wedge block having a relatively hard outer wear surface located radially outwardly from said body surface, and a bolt securing said wedge block to said body;

said outer side surfaces of the wedge block converging inwardly at a predetermined angle that is the same as the angle of the inwardly converging side walls of said recess, said angle being such so as to provide an interference fit between the outer side surfaces of said wedge block and the side walls of said recess.

Preferably said interference angle is between 1.5 to 3.5 degrees. Preferably the dimensions of the wedge block is slightly greater than that of the recess.

BRIEF DESCRIPTION OF THE DRAWINGS

Two embodiments of the invention are described hereunder in some detail with reference to and as illustrated in the accompanying drawings, in which.

DESCRIPTION OF THE PREFERRED EMBODIMENTS

Figure 1:
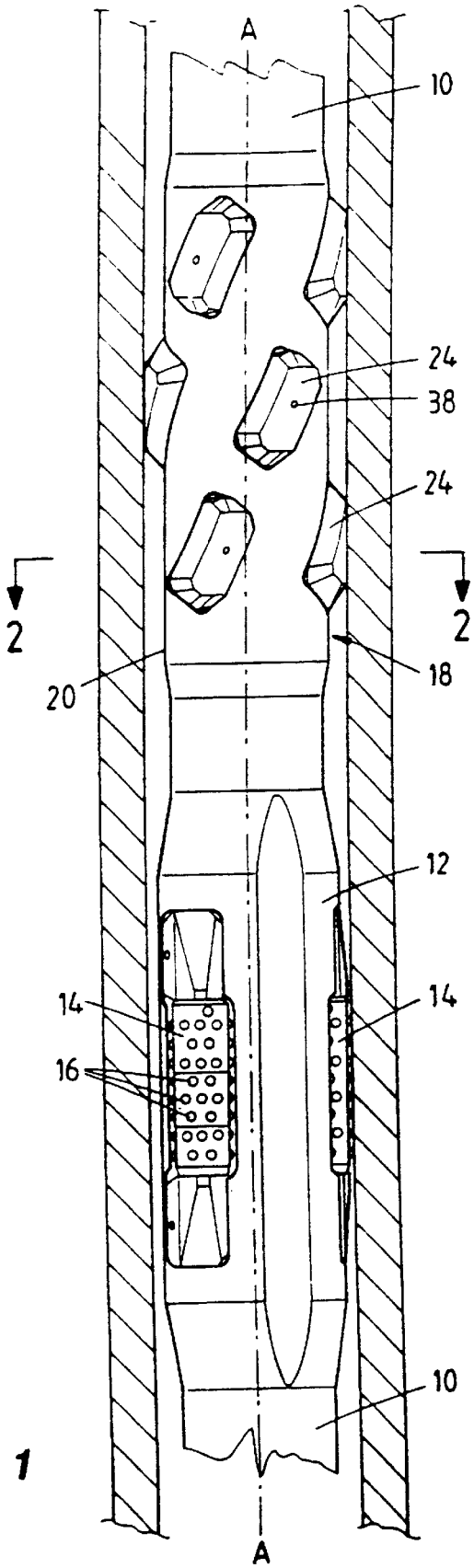
FIG. 1 is a fragmentary elevation which illustrates a reamer of a drill string surmounted by a drill bit stabiliser tool, according to a first embodiment.

With reference to the above figures it is to be understood that like elements are described by like numerals in the drawings. There is thus shown a drill string 10 that is provided with a bit assembly (not shown), and that is surmounted by a roller reamer 12 having three rollers 14 each with hard inserts 16 which may project or be flush with the outer surfaces of the rollers.

Above the roller reamer 12 there is provided the stabiliser tool 18 of this invention. Stabiliser tool 18 comprises a generally cylindrical body 20 rotatable about axis A—A, and which has (in this embodiment) three helical rows of recesses 22 (FIG. 2), the side walls 23 of recesses 22 converging radially inwardly by an angle of between 1.5 to 3.5 degrees. That angle is one that provide for an interference fit and provides abutment surfaces for side walls of wear pad assemblies 24.

Each wear pad assembly 24 includes a wedge block 28 whose outer side walls 29 converge radially inwardly. The outer side walls 29 converge by the same angle as the side walls 23 of the recesses 22. The central or wedge block 28 is urged inwardly and locked in place by a socket head bolt 30. The angle of the inwardly converging side walls 29 of the central wedge block is selected so as to provide an interference fit.

In the case of steel it has been found that angle may be some 1.5 to 3.5 degrees. If the angle is less than this 1.5 degrees or greater than 3 degrees it has been found that an interference fit does not occur and the holding force is solely provided by the bolt. It is however to be understood that other angles may equally well provide an interference fit, the angle being dependent on the material used.

The underside of the head of bolt 30 bears against a U-shaped washer 32 which allows the bolt to be positioned in the central wedge block 28 and the axially outer surface of the head of bolt 30 bears against an abutment surface 34, being an outer surface of a lateral slot 36 which contains washer 32 within the central block 28. There is an opening at 38 to allow access for a key (not shown) to engage in a recess in the head of bolt 30, both for tightening the wedge block 28 into position and also for releasing the wedge block 28. The wedge block 28 is provided with a hard metal surface 40, harder than the remainder of the block.

As can be seen from FIG. 2, the walls of the recesses 22 in this embodiment are symmetrical about a central radial plane marked AP in FIG. 2, although the outer hard surface 40 need not be symmetrical as described below. The walls of the recesses are at converging angle to the radial plane AP that results in an interference fit created between the wedge and the recess surfaces.

Figure 3:
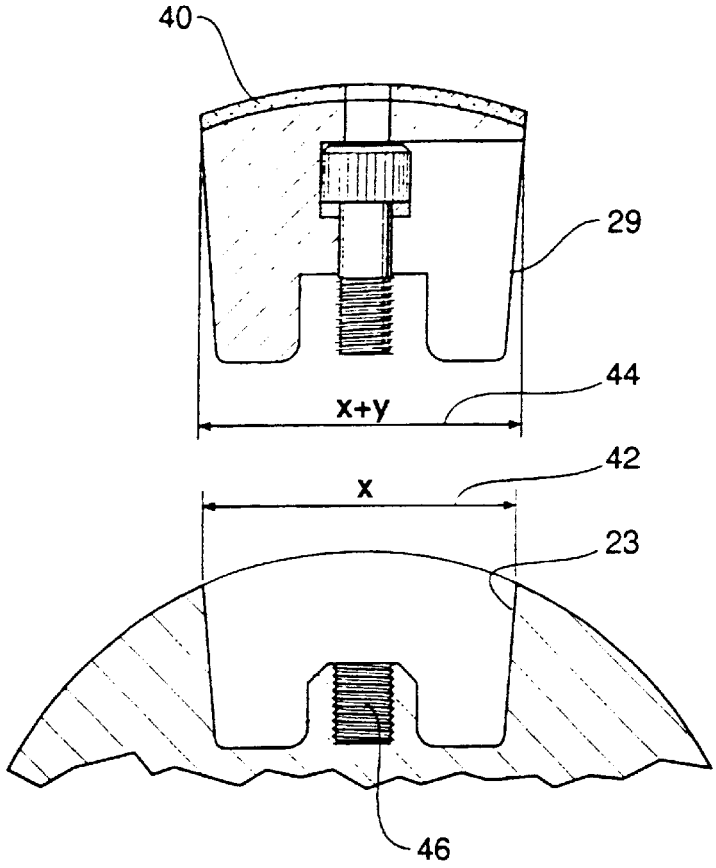
FIG. 3 is a schematic cross-sectional view of a pad assembly, showing the relative dimensions of the blocks prior to assembly.
Figure 4:
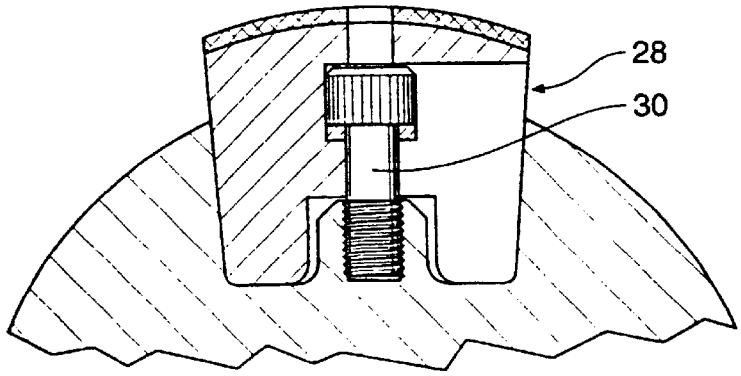
FIG. 4 is a schematic cross-sectional view of a pad assembly, after the block has been assembled.

To achieve an interference fit, it is preferable that the width of the wedge has to be slightly greater than that of the recess within which it is to be positioned. Thus, as seen in FIG. 3 the recess has a width 42 (x). The central wedge block 28 is of a width 44 (x+y) that is slightly greater than the width 42. The central block is then inserted into the recess, bolt 30 can then engage threaded bore 46 in the drill string 10 and urge the central wedge into the recess gap until the bottom of the wedge abuts the bottom of the recess, and wherein the wedge block still protrudes form the recess beyond the outer surface of the body to provide for the wear surface. Because the central wedge is slightly larger than the gap into which it was urged, an interference fit is achieved.

Figure 2:
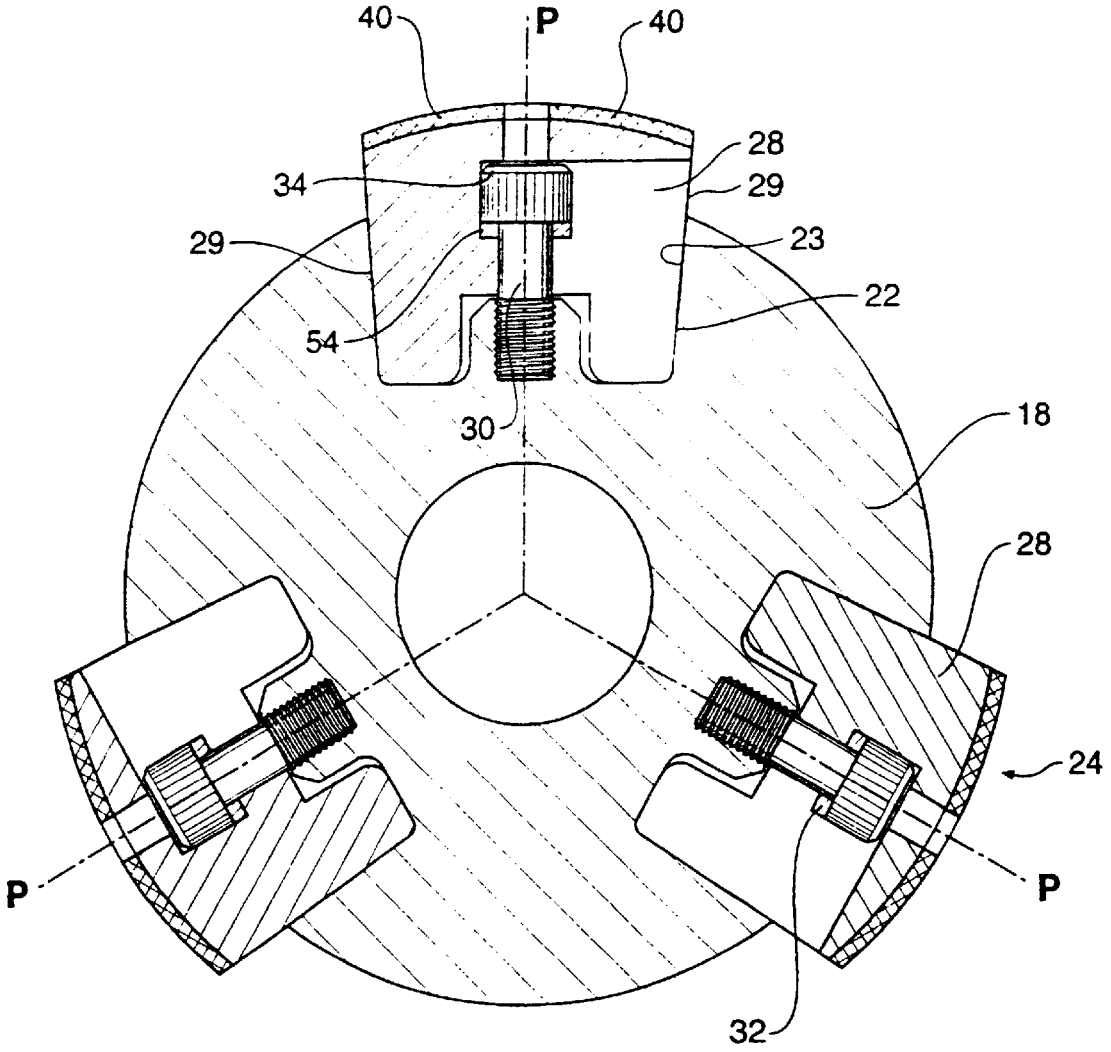
FIG. 2 is a cross-section taken on line 2—2 of FIG. 1, drawn to a larger scale.
Figure 5:
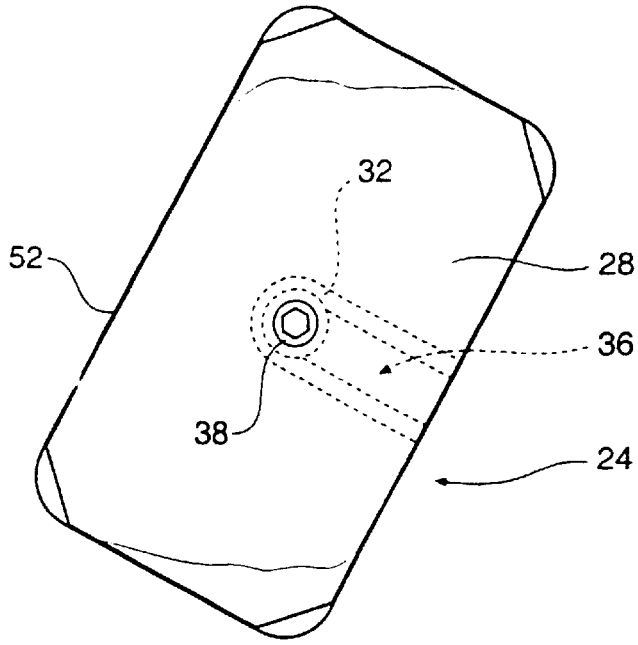
FIG. 5 is a front elevation of a pad assembly.

FIG. 5 shows the wedge block 28 as seen when looking along the line from P to A as shown in FIG. 2 which is central with respect to the socket, head bolt 30, and the side edges 52 of the. As shown in FIG. 5, viewed in the elevation the pad assembly 24 is approximately rectilinear (except for its corners) but as seen in FIG. 1, in other views it is not.

When assembled, the bolt 30 bearing against the washer 32, urges the wedge block radially inwardly, since the washer 32 abuts the inner surface 54 of the slot 36, so that rotation of the socket head bolt 30 in one direction will cause the wedge block 28 radially inwardly, but in the opposite direction the head of bolt 30 will abut the surface 34 and withdraw the wedge block. Once the wedge block is withdrawn, the bolt 30 along with its U-shaped washer 32 can be moved outwardly away from the wedge block through the lateral slot 36.

Figure 6:
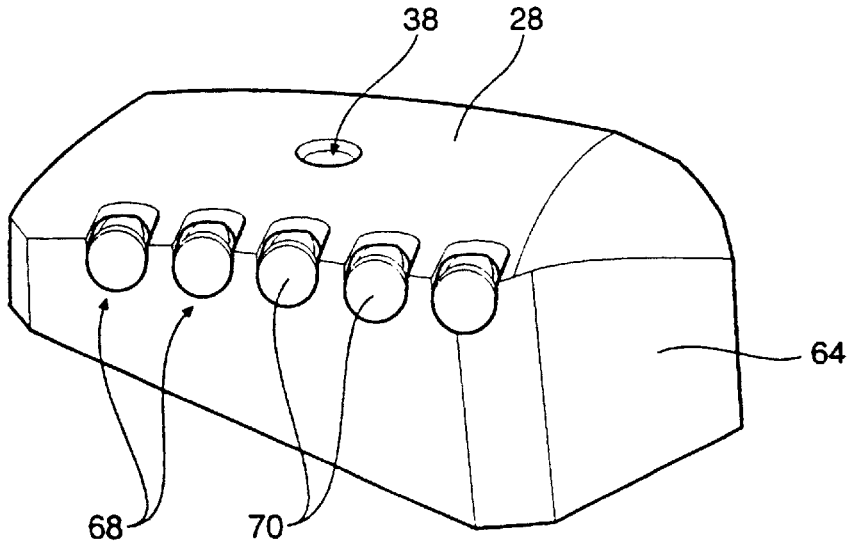
FIG. 6 is a perspective view of a pad assembly according to a second embodiment.
Figure 7:
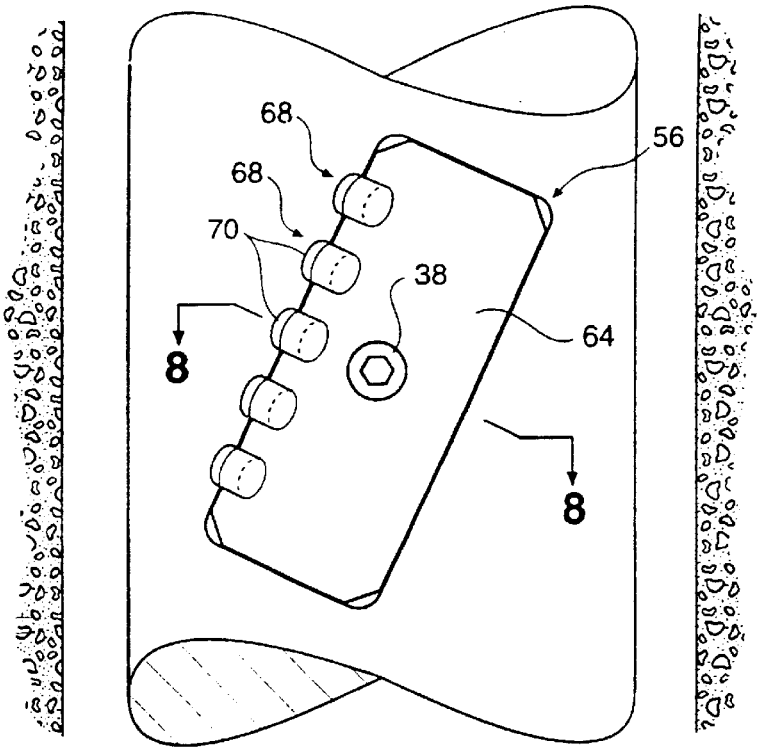
FIG. 7 is a front view of the pad assembly of FIG. 6.
Figure 8:
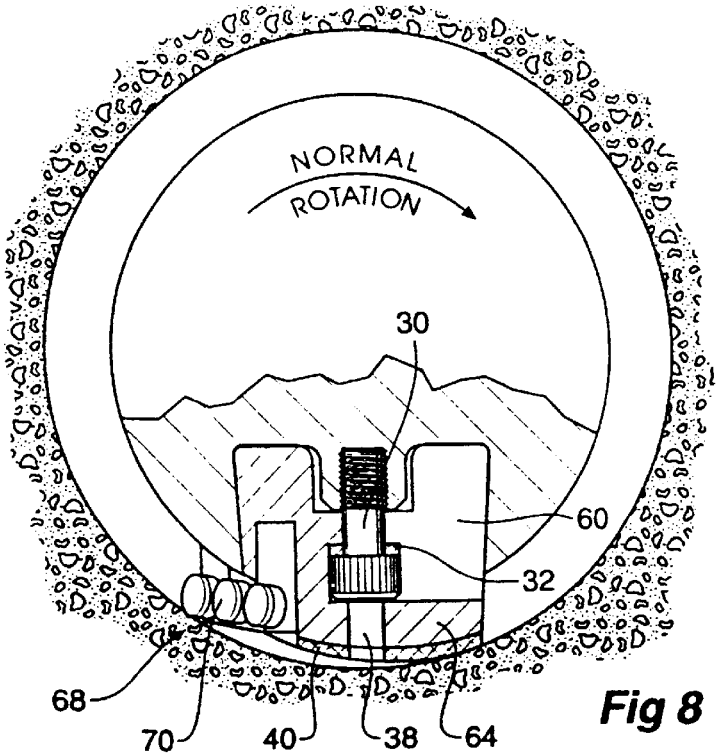
FIG. 8 is a fragmentary section taken on line 6—6 of FIG. 7.

Reference is now made to the second embodiment illustrated in FIGS. 6, 7 and 8. In that embodiment, a wear pad assembly 56 includes a wedge block 64 which is very similar to the wedge block 28 of the first embodiment. The bolt and washer arrangement is the same and those components bear the same designations 30 and 32, as in the first embodiment. However, as illustrated, the hard surfaces 40 of the wedge blocks diminish in radius from axis of rotation A towards the leading end 66 of a wedge block rotation in respect of the boring direction of the drill string. Thus there is provided a surface for tamping or compacting loose soil rearwardly of the leading end 66.

However, there is provided a plurality of tipped cutters 68, the tips 70 of which comprise discs of polycrystalline diamond. The leading cutters in respect of the boring direction of drill string rotation project further outwardly than the trailing cutters, but the faces of the tips 70 are inclined to provide a negative rake, which provides the most useful compromise in the cutters at that location. There are, however, only three pad assemblies with the tips as shown in FIGS. 6, 7 and 8, and those are the top three cutters of the stabiliser tool, the lower six pad assemblies being as described with respect to the first and second embodiments. This combination of pad assemblies wherein the three assemblies furthest from the reamers of the drill cutters provides a means whereby the cutters on the pas assemblies can assist in the withdrawal of a drill string, particularly when it is associated with a curved drill hole. In addition, this also provides means where, if the drill is used in soft earth, there is to some extent some tamping and consolidation of earth released by the cutters on the pad assemblies. This reduces to some extent the degree of build up of earth between the body of the tool of this invention and a reamer assembly, thereby assisting to some extent in reducing the load applied to the drill string. Furthermore, the cutters on the pas assemblies remain effective even when rotation is reversed as can sometimes occur during withdrawal to facilitate removal of the drill string.

While the invention has been described in terms of several preferred embodiments, the person skilled in the art will appreciate the various modifications, changes and substitutions which may be made without departing from the scope of the invention. The descriptions of the subject matter in this disclosure are illustrative of the invention and are not intended to be construed as limitations upon the scope of the invention.

What is claimed is:

1. A drill string stabilizer tool including a body having an outer surface symmetrical about an axis of rotation, and a plurality of recesses extending inwardly from said outer surface;

said recesses each including opposite recess surfaces which converge radially inwardly from said body outer surface toward the axis of rotation;

a plurality of pad assemblies in respective said recesses, each said pad assembly including a wedge block with opposed outer side surfaces converging radially inwardly toward the axis of rotation which are complementarily abutted by said recess surfaces;

each said wedge block having a relatively hard outer wear surface located radially outwardly from said body outer surface, and a bolt securing said wedge block to said body;

characterized by the inwardly converging outer side surfaces of the wedge block converging at a predetermined angle and the inwardly converging opposite surfaces of said recesses complementarily at the same pre-determined angle whereby said angle is chosen to provide an interference fit between the contacting complementarily outer side surfaces of said wedge block and opposite surfaces of said recesses as the wedge block is drawn into the recess by said bolt to lock the wedge block in said recess.

2. A drill string stabilizer tool including;

a) a body having an outer surface symmetrical about an axis of rotation, and a plurality of recesses extending inwardly from said outer surface and spaced in a helical configuration, said recess surfaces including opposite surfaces which converge inwardly towards the axis of rotation from said body outer surface, each said recess being symmetrical about a central radial plane of said body;

b) a plurality of pad assemblies in respective said recesses, each said pad assembly having a wedge block having an outer body surface and at least one pair of opposite sides converging towards said axis of rotation;

c) each said wedge block having a relatively hard outer wear surface located radially outwardly from said outer body surface, and a bolt securing said wedge block to said body;

e) each said wedge block containing surfaces defining a bolt hole extending from its said outer body surface to a radially inner surface, slot surfaces extending transversely from a side of said wedge block defining a lateral slot extending across said bolt hole;

f) a U-shaped washer contained in said slot, and said bolt having a head bearing against said washer, accommodated in said slot, and accessible through said bolt hole from a said outer wear surface of said wedge block;

wherein the inwardly converging at least one pair of opposite sides of the wedge block converge at a pre-determined angle and the inwardly converging opposite surfaces of said recesses complementarily converge at the same pre-determined angle whereby said pre-determined angle is chosen to provide an interference fit between the contacting complementary outer side surfaces of said wedge block and opposite surfaces of said recesses as the wedge block is drawn into the recess by said bolt to lock the wedge block in said recess.

3. A drill string stabilizer tool including;

a) an elongate body adapted for rotation about a body axis;

b) the body including an outer surface including a plurality of spaced perimetral recesses arranged in a helical array;

c) a plurality of wear pads each having wear surfaces and each positioned in an associated one of the recesses;

d) each pad having spaced side surfaces each which are complementary to an associated side surface of the associated recess and having a bolt securing each pad to the associated recess;

e) the side surfaces of each associated pad and recess complementarily contacting each other and converging oppositely from the body surface to a base of the recess at a predetermined obtuse angle whereby to provide retention of each such pad in its associated recess by an interference fit between the contacting complementary side surfaces of each associated pad and recess as the associated pad is drawn into the recess by said bolt so as to lock the pad in the recesses;

f) each pad including a wear surface for drill string guiding engagement with a wall of a bore hole; and g) the complementary surfaces being position transversely of imaginary planes bisecting the body whereby forces applied to each element of the drill string stabilizer tool due to frictional engagement of the wear surfaces with a bore hole wall are applied transversely of the complementary surfaces.

4. A drill string stabilizer tool as in any one of the above claims wherein said pre-determined angle is in the range between 1.5 to 3.5 degrees.

5. A drill string stabilizer tool as in claim 4, wherein the wedge blocks and the recesses are manufactured from mild steel.

6. A drill string stabilizer tool as in claim 5 wherein said pre-determined angle is approximately 2 degrees.

7. A drill string stabilizer tool as in any one of claims 1–3, wherein the wear blocks are positioned in a helical circumferentially disposed about the tool.

8. A drill string stabilizer tool as in any one of claims 1–3, wherein said wedge blocks are generally rectilinear in elevation, and side edges thereof are parallel in a plane normal to an axis of said bolt.

9. A drill string stabilizer tool as in any one of claims 1–3, further including hard tipped cutters projecting outwardly from the sides of the wedge block.

10. A drill string stabilizer tool as in any one of claims 1–3, wherein at least one of said wedge blocks further includes projecting hard tipped cutters.

11. A drill string stabilizer tool as in claim 10, wherein said hard tipped cutters are arranged in an array and such that the extent of projection of the cutters from a said block increases from the trailing end of said block to the leading end thereof, with respect to a boring direction of drill string rotation.

12. A drill string stabilizer tool as in claim 10, wherein it is only the uppermost of said wedge blocks that have said projecting hard tipped cutters.

13. A wear pad assembly for use with a drill string stabilizer tool of the type having a plurality of recesses each having side walls inwardly converging toward the axis of rotation of the drill string, said wear pad assembly including;

a wedge block having a body surface and at least one pair of opposite outer side surfaces such that each side surface is so shaped to complementarily abut said side walls of a recess;

each said wedge block having a relatively hard outer wear surface located radially outwardly from said body surface, and a bolt securing said wedge block to said drill string stabilizer tool;

said outer side surfaces of the wedge block converging inwardly at a pre-determined angle that is the same as the angle of the inwardly converging side walls of said recess, said pre-determined angle being such so as to provide an interference fit between the outer side surfaces of said wedge block and the side walls of said recess as the wedge block is drawn into the recess by said bolt to lock the wedge block in said recess.

14. A wear pad assembly as in claim 13, wherein said interference angels is in the range between 1.5 to 3.5 degrees.

15. A wear pad assembly as in claim 13, where the dimensions of each wedge block is slightly greater than that of the recess.

* * * * *